US007252412B2

(12) United States Patent
Wijbenga et al.

(10) Patent No.: US 7,252,412 B2
(45) Date of Patent: Aug. 7, 2007

(54) LUMINAIRE AND METHOD OF LIGHTING BY MEANS OF A LUMINAIRE

(75) Inventors: Hendrik Wijbenga, Eindhoven (NL); Jean Paul Entrop, Gastel (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/567,694

(22) PCT Filed: Aug. 3, 2004

(86) PCT No.: PCT/IB2004/051367

§ 371 (c)(1),
(2), (4) Date: Feb. 7, 2006

(87) PCT Pub. No.: WO2005/015078

PCT Pub. Date: Feb. 17, 2005

(65) Prior Publication Data

US 2006/0239007 A1 Oct. 26, 2006

(30) Foreign Application Priority Data

Aug. 12, 2003 (EP) ..... 03102506

(51) Int. Cl.
*F21V 5/00* (2006.01)

(52) U.S. Cl. ..... 362/328; 362/224; 362/309; 362/342

(58) Field of Classification Search ..... 362/328, 362/362, 365, 366, 326, 339, 148, 224, 290, 362/309, 342
See application file for complete search history.

(56) References Cited

U.S. PATENT DOCUMENTS 4,462,068 A * 7/1984 Shadwick ..... 362/332
5,416,683 A * 5/1995 McCarthy ..... 362/328
5,564,820 A * 10/1996 Entrop et al. ..... 362/362
6,053,625 A * 4/2000 Bowker ..... 362/348
6,250,780 B1 * 6/2001 Minissi et al. ..... 362/364

* cited by examiner

*Primary Examiner*—Alan Cariaso
*Assistant Examiner*—Leah S. Lovell

(57) ABSTRACT

The luminaire has a reflector (10) having a light emission window (15), near to first opposed edges (16) of which respective sets of strips (25) are present to create a cut-off angle β. The reflector (10) is closed by a hood (30) which, along first walls (31) thereof close to the first edges (16), have refracting elements (35) to cause the luminaire to emit light at small angles to the light emission window (15), within the cut-off angle β. The luminaire is suitable to be used for under canopy lighting of a petrol station and to signal to the distance that the station is open, without dazzling oncoming drivers. The method involves the use of the luminaire mounted to the ceiling of the canopy.

9 Claims, 4 Drawing Sheets

LUMINAIRE AND METHOD OF LIGHTING BY MEANS OF A LUMINAIRE

The invention relates to a luminaire suitable for under canopy lighting. The invention further relates to a method of lighting an area under a canopy of a petrol station by means of a luminaire.

A luminaire of this kind is known from U.S. Pat. No. 5,564,820. The luminaire has two opposing sets of strips in its light emission window. When mounted into the false ceiling of or at the ceiling of the canopy of a petrol station, the strips prevent approaching traffic, which faces the strips, from becoming dazzled by light directly emitted without prior reflection, within small angles of up to about 30° to the ceiling. The reflector, however, reflects light in both directions transverse to the direction of the traffic also within said angles for illuminating vertical surfaces of the petrol pumps. The reflector may shape a beam ranging from about 20° to 90° to the ceiling, with a maximum at about 55°. The light emission window is covered by a flat pane. The luminaire shown has a housing and is destined for a single-capped lamp.

U.S. Pat. No. 6,254,255 B1 discloses a similar luminaire having a specially shaped reflector suitable for petrol station lighting. This luminaire has sets of strips in the light emission window, too. The difference in intensity of the light beams in the direction of the traffic, continuous line, and transverse thereto, interrupted line, is shown in FIG. 4 thereof. It is seen that the bat wing shaped transverse beam reaches at either side up to smaller angles to the ceiling, line 90°-90°, than does the beam in the direction of the traffic, which beam has a large cut-off angle. As a result of this large cut-off angle, approaching traffic is not dazzled by the light emitted, but is not able to observe from a large distance that the petrol station is opened. A double-capped lamp is shown in the luminaire. A flat shield closes the light emission window.

Still another luminaire is known from U.S. Pat. No. 6,227,684 B1, which has strips in the light emission window and a flat pane, too. The luminaire is, however, designed to produce a light beam, which is asymmetrical in one direction. When mounted near the edge of the ceiling of a petrol station, it is achieved that pumps further remote from that edge are illuminated, but that substantially no light is emitted towards the road running along the station.

It is a disadvantage of the known luminaires that the strips, which create a large cut-off angle downwards from the horizontal to prevent dazzling, render it impossible to observe from a large distance that a lamp in the luminaires is operated.

It is a first object of the invention to provide a luminaire suitable for under canopy lighting, which upon operation obviates dazzling of oncoming drivers, but nevertheless signals over a relatively large distance that it is operated.

It is a second object of the invention to provide a method of lighting an area under a canopy of a petrol station by means of a luminaire, by which dazzling of oncoming drivers is obviated, but by which it is nevertheless signaled over a relatively large distance that it is operated.

The first object is achieved with the luminaire claimed in claim 1.

The invention will be explained and described with reference to the luminaire in the mounted state, the light emission window being in a horizontal plane and facing downward.

The strips are necessary for preventing dazzling. The strips at the same time preclude the emission of light at a small angle to the horizontal in the known luminaires, which would indicate from a distance that the luminaire is operated. The refracting element of the luminaire of the present invention present along a first wall does not receive light directly from the lamp, because it is screened by the adjacent strips, nor does it for the same reason receive reflected light from the reflector. However, since the strips are chosen to be light-diffusing, the strips adjacent the other first wall, and particularly the one closest to the plane of symmetry, send diffusely reflected light towards the refracting element This light is refracted upward. If the strips were chosen to be specularly reflecting, they would generally reflect light into steeper directions, and the reflected light would not or substantially not reach the refracting element.

The diffuse reflection by the strips is of major importance for the homogeneity of the irradiation of the refracting element and thus for the homogeneity of the light emitted thereby, and for distributing the amount of light so as to prevent dazzling.

The strips may be of metal, which is e.g. white coated, e.g. lacquered, or matt so as to be light-diffusing.

The refracting element may be present at the outside of the hood, but it is advantageous if the element is inside the hood. It is then obviated that the element becomes dirty, and the hood may have a smooth outer surface, which facilitates its cleaning.

The refracting element may be a separate part, but favorably the element is integral with the at least one first wall. This feature saves assembling costs and, more particularly, prevents loss of light which would otherwise occur at the additional boundaries a separate part would bring about.

It is favorable if the refracting element is composed of a number of refracting sub-elements, each having a base and a top. This embodiment has several advantages: it takes less material and is slimmer; the hood is lighter; and it allows for the tops of the sub-elements to be given different angles for adjusting them to their differing positions with respect to the relevant strips. For instance, the sub-element closest to the light emission window may have a top angle which is e.g. 1° smaller than the neighboring one.

It is advantageous if the luminaire has the feature of claim 5. The bases in this event have a minor effect themselves as only little light will reach them. The planes in which the bases are situated may intersect the strip in a common line, e.g. at half its height.

Favorably, the hood consists of transparent material, for instance of glass or a polymer like polycarbonate or polymethacrylate. More favorably, the luminaire has the feature of claim 6. This feature makes its possible to manufacture the hood in a relatively simple two-part mold, because the mold will release the hood when being opened.

If case a petrol station is accessible to traffic from opposing directions, it is favorable if the luminaire has the feature of claim 7.

In a favorable embodiment, the luminaire has the feature of claim 8. The housing protects the luminaire against damage and against the penetration of dust and/or vapor, e.g. petrol vapor.

The reflector may be of specularly reflecting, semi-specularly reflecting, or matt material, e.g. metal, for instance aluminum. The holding means may be designed to hold and to feed a single-capped lamp, such as a lamp having a screw base or a bayonet base. Alternatively, the holding means may be suited to hold a double-ended capped lamp, e.g. having R7s caps.

The reflector may be shaped to give a light beam which is symmetrical in said plane of symmetry only or which is also symmetrical in a plane transverse thereto.

In the former case, the luminaire is particularly suitable for use near the edge of a canopy, in the latter case the luminaire may be mounted between two rows of petrol pumps.

Suitably, a high-pressure discharge lamp is used in the luminaire, e.g. a high-pressure sodium lamp, but particularly a high-pressure metal halide lamp, e.g. a lamp consuming a power of 150 to 250 W. Such lamps may have, for example, a ceramic discharge vessel inside a glass, generally a quartz glass outer envelope.

The second object of the invention is achieved in that the luminaire of the invention containing an electric lamp is operated while mounted to the ceiling of a petrol station, the sets of strips being transverse to a direction of traffic.

These and other aspects of the luminaire according to the invention will be apparent from and be elucidated with reference to the drawings, in which FIG. 1 is a cross-section through a central plane of a first embodiment;

Figure 1:
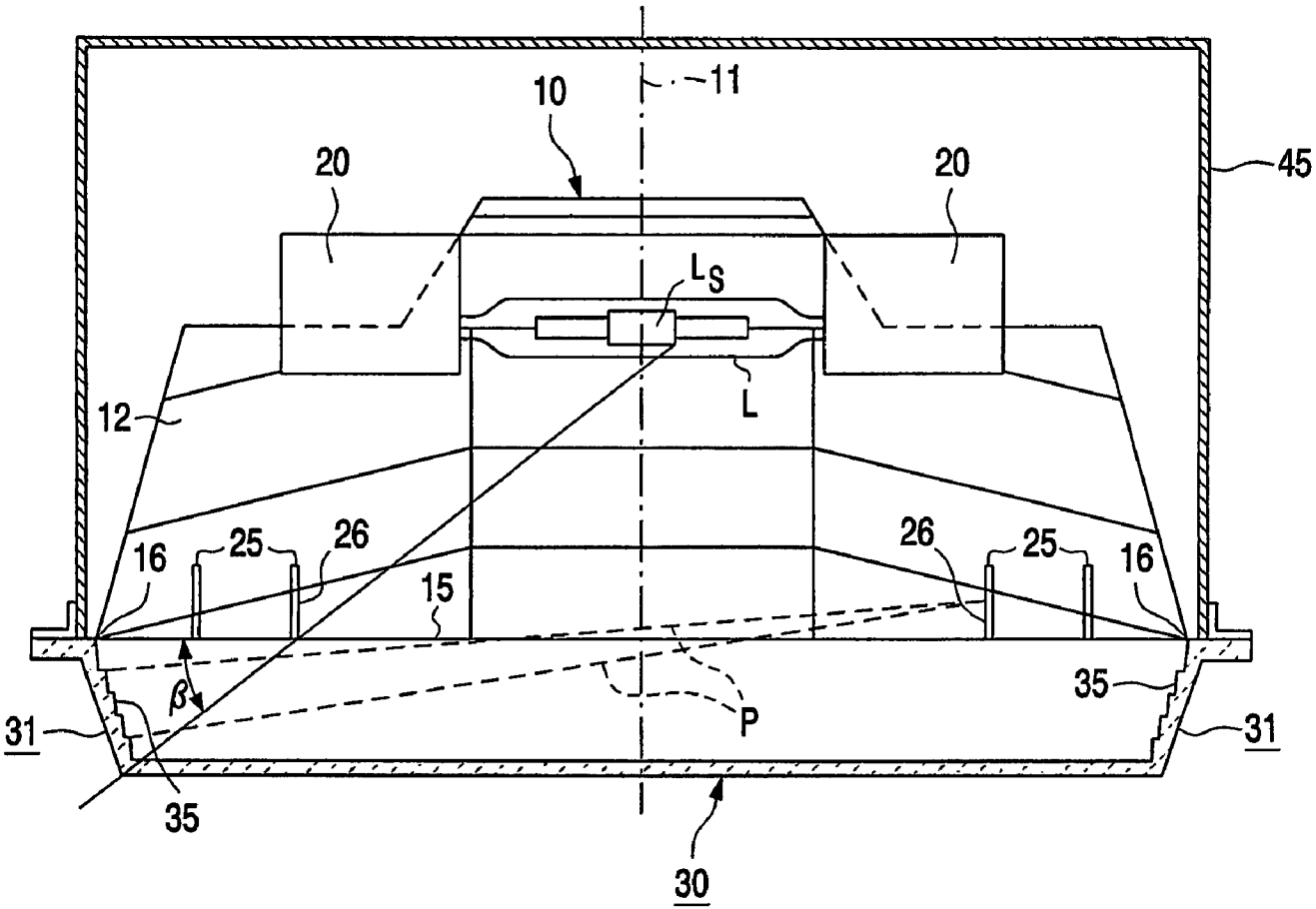
Figure 2:
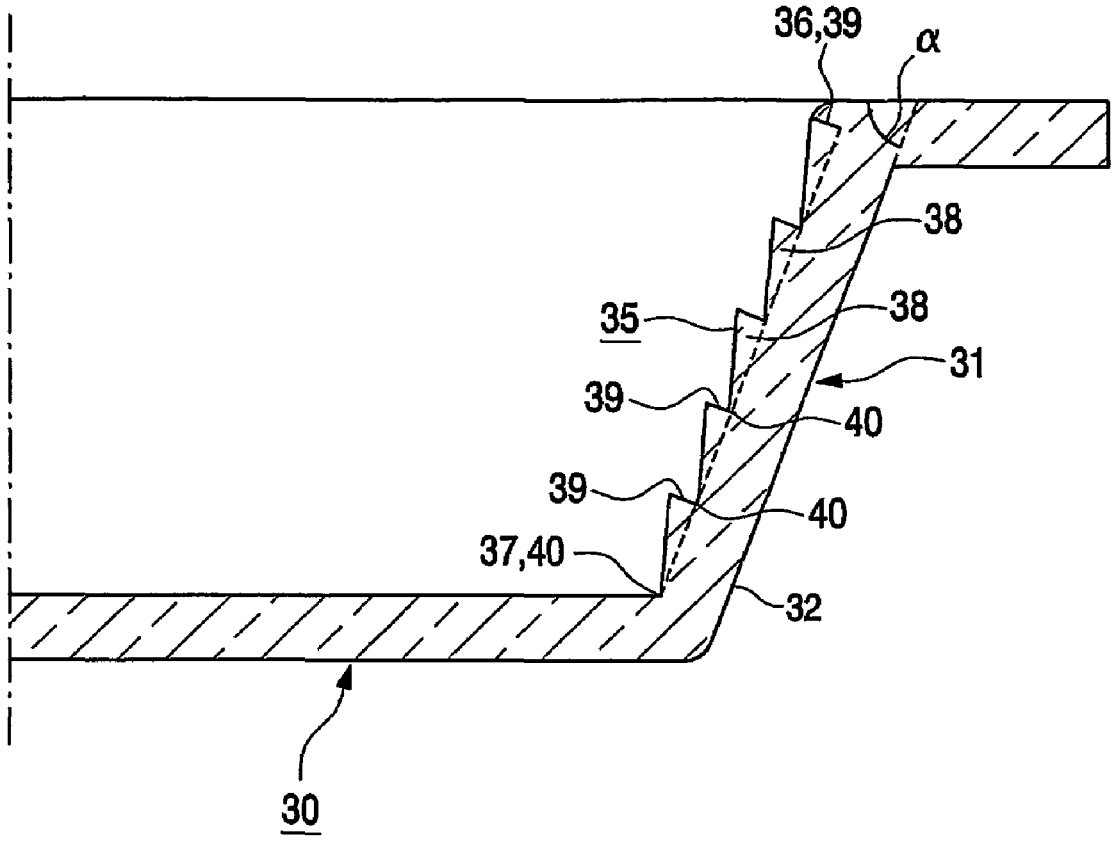
FIG. 2 shows a detail of FIG. 1.

In FIG. 1, the luminaire has a concave reflector 10 with a plane of symmetry 11, which reflector 10 defines a cavity 12. The central plane of the cross-section divides the luminaire into two substantially equal portions. The reflector 10 is of semi-high-gloss aluminum, but it may alternatively be of high-gloss metal or of matt metal, or may alternatively be coated. A light emission window 15 is tangent to the reflector 10, extends transverse to the plane of symmetry 11, and has first edges 16 along the plane of symmetry 11. Holding means 20 are present for accommodating an electric lamp L in the cavity 12 of the reflector 10, with an elongate light source Ls of said lamp L transverse to the plane of symmetry 11. In the Figure a double-ended metal halide lamp L having a ceramic discharge tube is schematically indicated. A set of strips 25, in the Figure of white coated aluminum, is mounted adjacent each of the first edges 16. The sets 25 extend substantially from the light emission window 15 into the cavity 12, the strips being light-diffusing. The strips create a cut-off angle β within which no light is emitted. A light-transmitting hood 30 covers the light emission window 15. The hood 30 has first walls 31 which extend away substantially from the first edges 16, outside the cavity 12. A light-refracting element 35 is present along at least one of the first walls 31. The element 35 has a base 36, see FIG. 2, facing the light emission window 15 and a top 37 remote from the light emission window 15. The element 35 is able to cause light to emanate within an angle of up to 5° to the plane of the light emission window.

The element 35 is able to do this, although it is completely within the cut-off angle β: the strip 26 at the other side of the plane of symmetry 11 throws diffusely reflected light onto the refracting element 35 and so does to a lesser extent the other strip, because the other strip is able to contribute by its lower end, only.

In FIG. 1, the refracting element 35 is present inside the hood 30. It is integral with the at least one first wall 31. The element 35 is composed of a number of refracting sub-elements 38, each having a base 39 facing the light emission window 15 and a top 40 remote from the light emission window 15, cf. also FIG. 2. In the embodiment shown, the refracting element 35 has five sub-elements 38. The top angle decreases from 15° for the angle of the sub-element 38 remote from the strip 26 to 11° for the angle of the sub-element closest to the strip 26. This is because the remote sub-element 38 has to deflect light over a larger angle than the closest sub-element 38.

The refracting element 35 is at one side of the plane of symmetry 11 and the bases 39 are situated in planes P intersecting a strip 26 of the set of strips 25 which is closest to the refractive element 35 and which is present at another side of the plane of symmetry 11.

The at least one first wall 31 encloses, at a surface 32 thereof facing away from the refracting element 35, an angle α with the light emission window 15 in a range of 66° to 74°. This angle is 70° in the Figure.

A similar refracting element 35 is present along the other one of the first walls 31.

The reflector 10 is accommodated in a housing 45. The hood 30 seals off the housing 45. The hood 30 is of polycarbonate, but may alternatively be of glass, as the refractive indices of these materials are about the same. The luminaire is suitable to be used for under canopy lighting of a petrol station.

Figure 3:
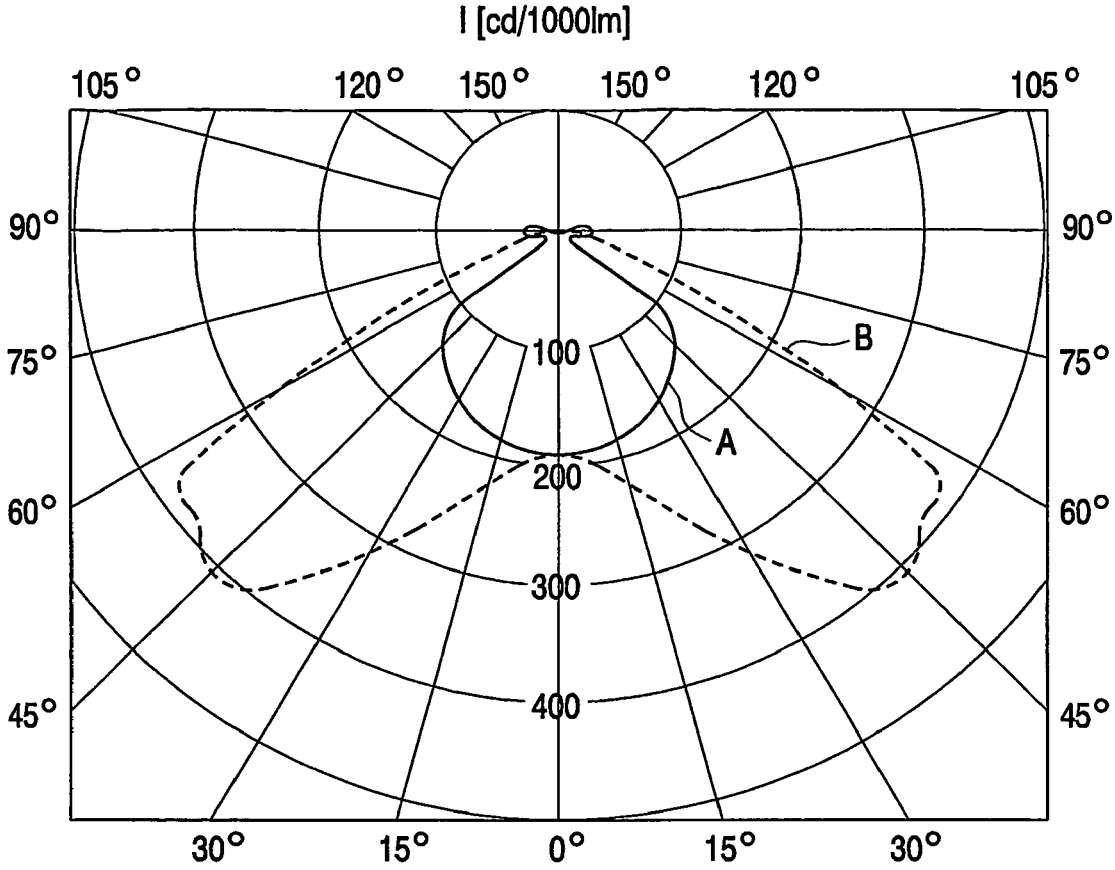
FIG. 3 shows light intensity-distribution diagrams of the luminaire of FIGS. 1 and 2.

In FIG. 3, the intensity distribution in the plane of symmetry 11 is shown with a dashed line B, the distribution in the plane of drawing of FIG. 1 with a continuous line A. It is apparent, that now a small amount of light is emitted at large angles. $I_{87}$ to $I_{90}$ is about 15 cd/10001 m. The beams B are each able to illuminate petrol stations with two rows of pumps and the paving between the rows, the luminaire producing the beams being mounted in or at the ceiling in between the rows. The beam A illuminates the paving as far as the beam stays within an angle of about 50° to the vertical, and signals into the distance by means of its small lobes at wider angles that the luminaire is operating and that the station is open.

Figure 4:
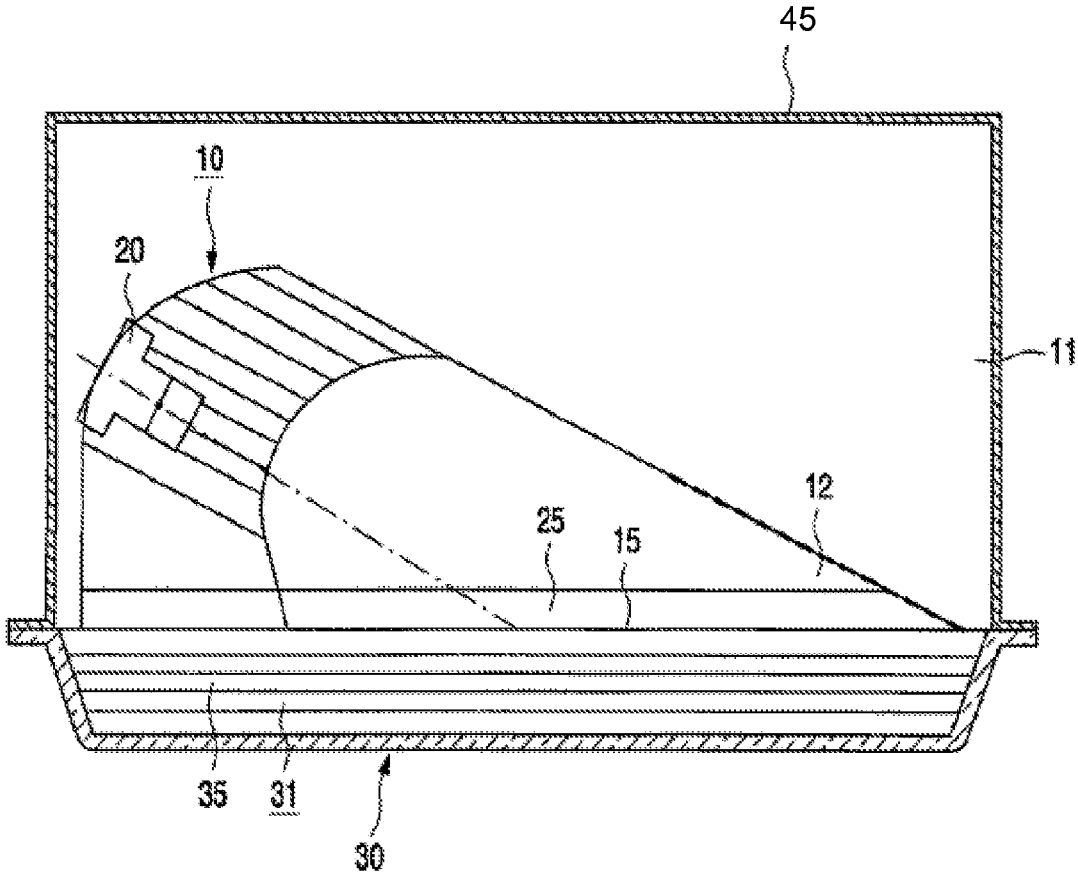
FIG. 4 is a cross-section through the plane of symmetry of a second embodiment.

FIG. 4 shows a luminaire producing an asymmetric beam. The reference numerals correspond to those of FIGS. 1 and 2. The light beam is directed to the right. The luminaire is suitable for illuminating an outermost row of petrol pumps of a series of rows, the left of the luminaire in FIG. 4 facing the public road. The plane of drawing in this Fig. coincides with the plane of symmetry 11.

The invention claimed is:

1. A luminaire suitable for under canopy lighting, comprising:

a concave reflector (10) with a plane of symmetry (11) and defining a cavity (12);

a light emission window (15) tangent to the reflector (10), transverse to the plane of symmetry (11), and having first edges (16) along the plane of symmetry (11);

holding means (20) for accommodating an electric lamp L in the cavity (12) of the reflector (10), with an elongate light source Ls of said lamp L transverse to the plane of symmetry (11);

a set of strips (25) adjacent the first edges (16), extending substantially from the light emission window (15) into the cavity (12), said strips being light-diffusing, wherein the strips create a cut-off angle β with respect to the light emission window (15) within which no light is emitted directly from the lamp;

a light-transmitting hood (30) covering the light emission window (15), said hood (30) having first walls (31) extending substantially away from the first edges (16); and a light-refracting element (35) disposed within a region of the cut-off angle β and along at least one of the first walls (31) of the light-transmitting hood (30), the element (35) having a base (36) facing the light emission window (15) and a top (37) remote from the light emission window (15), wherein the light-refracting element is configured to cause light emitted from said lamp L that is diffusely reflected from one of the strips at an opposite side of the plane of symmetry to emanate within an angle of up to 5° to the light emission window (15).

2. A luminaire as claimed in claim 1, characterized in that the refracting element (35) is present inside the hood (30).

3. A luminaire as claimed in claim 2, characterized in that the refracting element (35) is integral with the at least one first wall (31).

4. A luminaire as claimed in claim 3, characterized in that the refracting element (35) is composed of a number of refracting sub-elements (38), each refracting sub-element (38) having a base (39) facing the light emission window (15) and a top (40) remote from the light emission window (15).

5. A luminaire as claimed in claim 4, characterized in that the refracting element (35) is at one side of the plane of symmetry (11), and the bases (39) of the refracting sub-elements (38) are each situated in a plane P intersecting a strip (26) of the set of strips (25) which is closest to the refractive element (35) and is present at another side of the plane of symmetry (11).

6. A luminaire as claimed in claim 3, characterized in that the at least one first wall (31), at a surface (32) thereof facing away from the refracting element (35), includes an angle $\alpha$ with the light emission window (15) that lies in a range of 66° to 74°.

7. A luminaire as claimed in claim 1, characterized in that a similar refracting element (35) is present along the other one of the first walls (31).

8. A luminaire as claimed in claim 1, characterized in that the reflector (10) is accommodated in a housing (45), the hood (30) sealing off the housing (45).

9. A method of lighting an area under a canopy of a petrol station by operating an electric lamp in a luminaire which is mounted to a ceiling of the canopy and which comprises:

a concave reflector (10) with a plane of symmetry (11) and defining a cavity (12);

a light emission window (15) tangent to the reflector (10), transverse to the plane of symmetry (11), and having first edges (16) along the plane of symmetry (11);

holding means (20) for accommodating an electric lamp L in the cavity (12) of the reflector (10), with an elongate light source Ls of said lamp L transverse to the plane of symmetry (11);

a set of strips (25) adjacent the first edges (16), extending substantially from the light emission window (15) into the cavity (12), said strips being light-diffusing, wherein the strips create a cut-off angle $\beta$ with respect to the light emission window (15) within which no light is emitted directly from the lamp;

a light-transmitting hood (30) covering the light emission window (15), said hood (30) having first walls (31) extending away substantially from the first edges (16); and a light-refracting element (35) disposed within a region of the cut-off angle $\beta$ and along at least one of the first walls (31) of the light-transmitting hood (30), the element (35) having a base (36) facing the light emission window (15) and a top (37) remote from the light emission window (15), wherein the light-refracting element is configured to cause light emitted from said lamp L that is diffusely reflected from one of the strips at an opposite side of the plane of symmetry to emanate within an angle of up to 5° to the light emission window (15), the sets of strips being transverse to a direction of traffic.

* * * * *